United States Patent [19]

Wellershaus

[11] 3,930,349

[45] Jan. 6, 1976

[54] BRACED GIRDER OF TRIANGULAR SECTION

[75] Inventor: Hartmut Wellershaus, Wassenach, Germany

[73] Assignee: Rheinische Filigranbau GmbH & Co. KG, Nickenich, Germany

[22] Filed: June 11, 1974

[21] Appl. No.: 478,229

[30] Foreign Application Priority Data

June 13, 1973 Germany ..... 2330079
Oct. 3, 1973 Germany ..... 7335804[U]

[52] U.S. Cl. ..... 52/655; 52/648; 52/694
[51] Int. Cl.[2] ..... E04C 5/06
[58] Field of Search ..... 52/648, 655, 692, 694

[56] References Cited

FOREIGN PATENTS OR APPLICATIONS

| | | | |
|---|---|---|---|
| 873,864 | 4/1942 | France | 52/648 |
| 610,932 | 10/1960 | Italy | 52/692 |
| 677,792 | 12/1964 | Italy | 52/694 |
| 1,325,114 | 3/1963 | France | 52/648 |
| 78,294 | 5/1962 | France | 52/692 |
| 212,962 | 1/1958 | Australia | 52/694 |
| 488,073 | 5/1970 | Switzerland | 52/648 |

*Primary Examiner*—Alfred C. Perham
*Attorney, Agent, or Firm*—Brumbaugh, Graves, Donohue & Raymond

[57] ABSTRACT

A braced girder for steel-reinforced concrete construction, comprising a top chord connection to two bottom chords by a continuous lacing which forms a repeating pattern consisting of braces which are at least roughly perpendicular to the top chord, and of diagonal braces. At least two braces in the continuous lacing are perpendicular to the chord and follow each other consecutively. The girder has a triangular cross section. Where the two panel planes meet, the lacing forms a radius which is at least 0.4 times the diameter of the top chord. A method and apparatus for preparing such a girder are also disclosed.

4 Claims, 14 Drawing Figures

Figure 5:
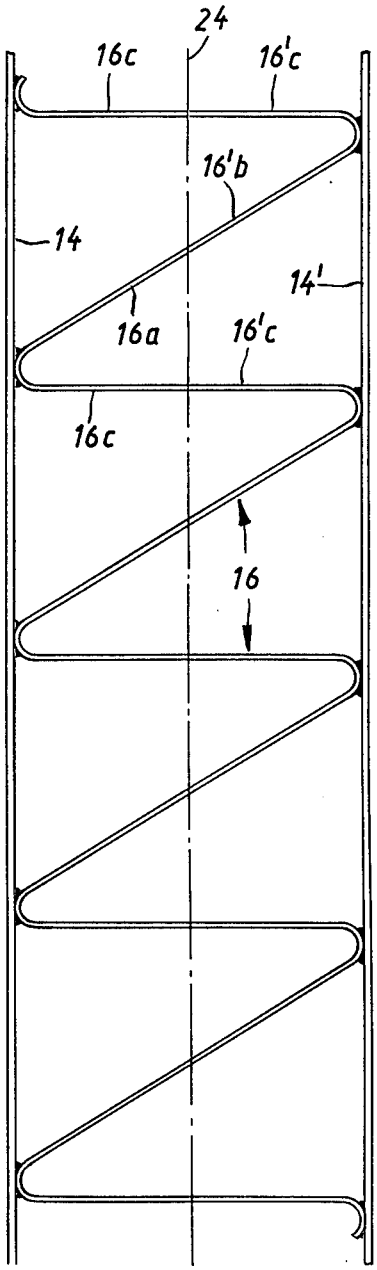

Fig. 1
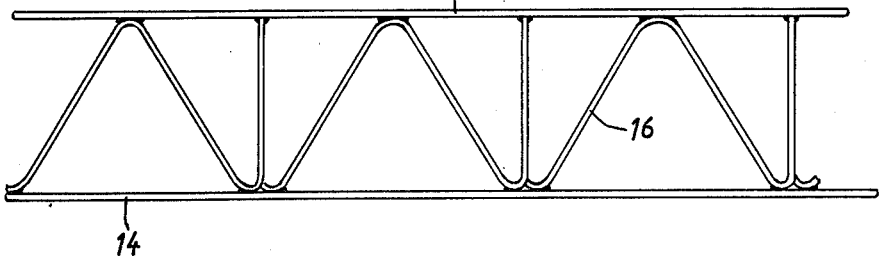
Fig. 2
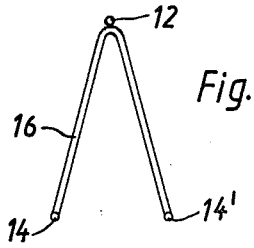
Fig. 3
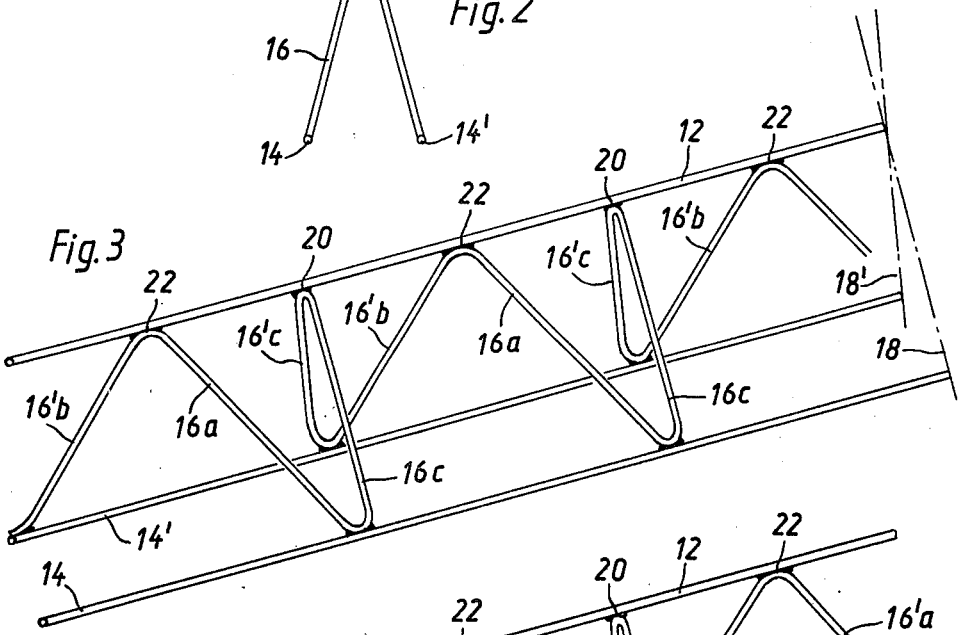
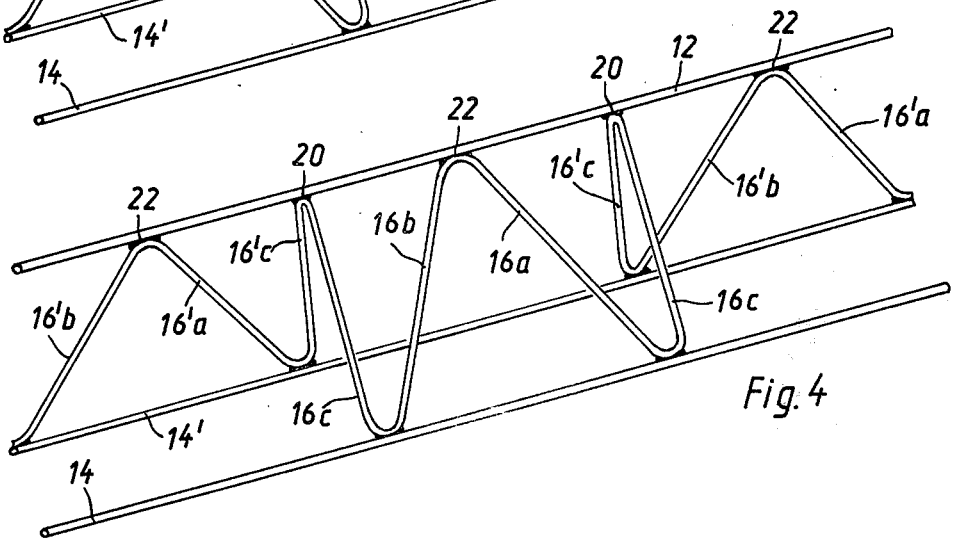
Fig. 4

Fig. 7
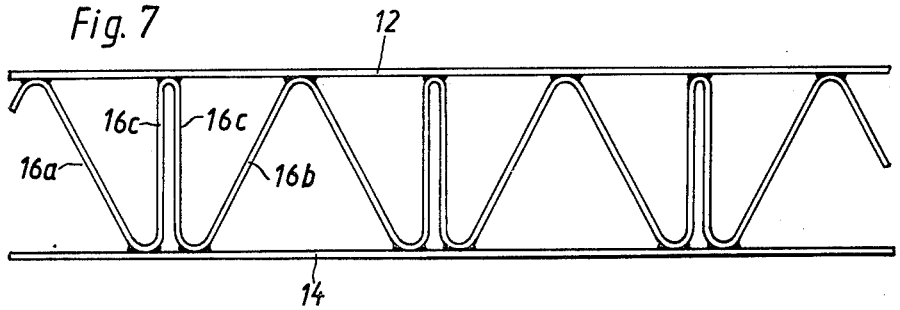
Fig. 8
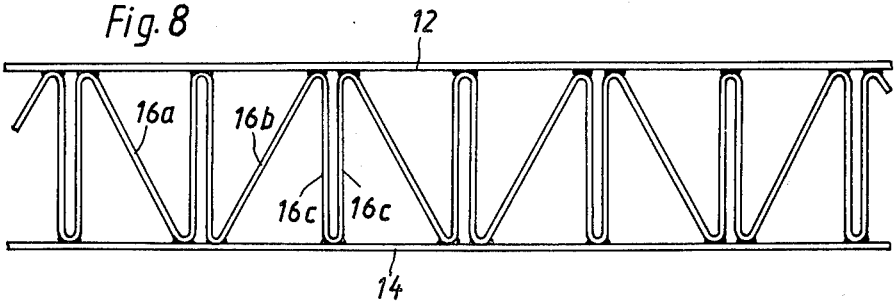
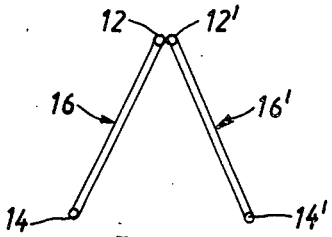
Fig. 9
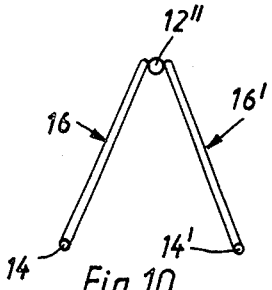
Fig. 10
Fig. 11
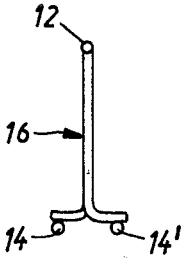
Fig. 12
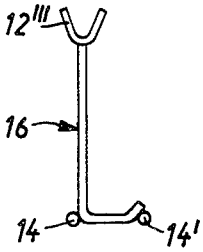
Fig. 13
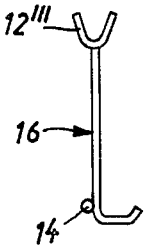

BRACED GIRDER OF TRIANGULAR SECTION

The invention relates to braced girders for steel-reinforced concrete construction comprising a top chord and at least one bottom chord interconnected by lacing consisting of a repeating pattern of braces which are approximately perpendicular to the top chord as well as of braces which are diagonal.

Braced girders of this type are principally used for the production of floors between storeys from semifinished components. In this system thin concrete sheets are prefabricated and the bottom chord or chords as well as part of the height of the bracing of open-web girders are embedded in the concrete. These thin concrete sheets can then be lifted off the moulds on which they have been cast after only a short period of time has been allowed for the concrete to set, because the open-web girders not only strengthen the concrete but also sufficiently distribute the load due to the weight of the sheets when they are lifted to permit them to be handled by a crane or some other hoisting tackle. Owing to their low weight the thin concrete sheets and the partly encast open-web girders can be conveniently hoisted and precisely placed at the site where they then in turn serve as shuttering for the pouring of a thick slab in situ to a depth which also covers and embeds the upper chords of the girders. The open-web girders are intended to strengthen the thin concrete sheets to a sufficient extent for them to carry the weight of the concrete poured at the site even when the spans are considerable.

In known braced girders of the described kind (German Patent Specification laid open under No. 2,115,119 and Swiss Pat. No. 378,505) a top chord is connected to each of two bottom chords by continuous lacing in which a brace extending perpendicularly from the top chord to a bottom chord intervenes between each two diagonal braces between the top chord and the same bottom chord.

These known braced girders of the specified kind have the advantage over open-web girders containing only diagonal bracing that the total weight of the bracing related to their ability to take up shearing loads in a completed steel-reinforced concrete structure is particularly favourable. In other words, braced girders of the specified type provide the means of providing steel-reinforced structures in which predetermined shearing stresses in the finished structure must be expected to arise, at a particularly low cost in material for the bracing of the open-web girders. However, in known girders of the contemplated kind a greater expenditure in material for the bracing is still necessary to permit the girders to carry the loads which arise during erection, so that in practice the ability of such girders to take up shear in the finished structure cannot be utilised to the full. The relatively low load-bearing strength of known girders of the contemplated kind during erection, i.e. until the concrete in which they are fully embedded has set, is due to the inferior buckling resistance of those diagonal braces which in the existing conditions of stress and load are subject to compression.

It is therefore the object of the present invention to improve a braced girder of the specified kind in such a way that a favourable ratio of the total weight of the bracing to the contribution this makes to providing the finished steel-reinforced concrete structure with shear strength can be maintained even with regard to the loads that arise during erection.

According to the invention this object is achieved by the incorporation in the continuous lacing of two directly consecutive braces which are perpendicular to the top chord.

In a braced girder of given overall dimensions in which a given amount of material is used for the lacing the invention results optionally either (a) in a reduction of the overall length of all the braces so that they can individually have a larger cross section for the same expenditure in material, or (b) in a symmetrical disposition of the braces with respect to any plane normal to the longitudinal axis of the girder through a node at the top chord, so that consequently the loads arising during erection are particularly favourably distributed between the braces.

In both instances a balanced relationship between the loads arising in the finished reinforced steel structure and the loads arising during erection can be achieved so that the loads during erection do not, as is the case in conventional girders, prevent the ratio of the total weight of the bracing to their contribution towards providing the finished structure with shear strength from being optimalised.

In braced girders of triangular cross section comprising a top chord and two relatively spaced bottom chords the invention is preferably performed by making all the braces form parts of a continuous lacing in which each brace extending perpendicularly between one bottom chord and the top chord is directly followed by a similar perpendicular brace between the top chord and the other bottom chord.

Alternatively two braces extending perpendicularly from the top chord may be directly adjacent and descend to the same bottom chord as a pair. Continous lacing of this kind may be provided either in the form of one lacing connecting top and bottom chords of an open-web girder or alternatively two like continuous lacings may be provided between a top chord and two bottom chords disposed to form an open-web triangular section space girder.

The invention also relates to a method of producing braced girders in which a top chord is connected directly to each of two bottom chords by substantially straight braces forming parts of a single continuous lacing contained in each of two panel planes intersecting in the axis of the top chord. According to the invention when bending the continuous lacing, originally coplanar lengths of about twice the length of a brace are formed and these lengths are then folded at their centres about a common axis to form two braces each in a different panel plane.

This simplifies the production of the continuous lacing because the number of bends which must be formed in the original common plane is less than the number of nodes in the finished open-web girder. All the remaining bends, i.e. bends where the continuous lacing forms nodes at the top chord in the finished girder, are produced simultaneously in at least pairs by bending the lacing about the common median bending axis.

Preferably the continuous lacing is bent where the two panel planes meet, to form a radius at least equal to 0.4 times the diameter of the top chord. Open-web girders are thus obtained which can be readily stacked.

For performing the proposed method apparatus is used which likewise forms part of the present invention, and which comprises located along a feed path for the lacing, two bending punches having faces relatively placed in a manner defining a U or a V, a forming beam engaging the space between the bending punch faces, and a drive means for intermittently feeding the lacing, relative reciprocating motion of the bending punches in relation to the forming beam normal to the direction of feed and to the original plane of the lacing being generated during the intervals between feeding steps.

In a preferred embodiment of this arrangement the forming beam is provided on the entry side of one of the punches with a clamping face in the original plane of the lacing and at the exit side of the other punch with another clamping face contained in the associated panel plane, both clamping faces coperating with a downholder operable in tined relationship with the punches.

The invention will now be more particularly described with reference to drawings which schematically illustrate embodiments of the invention. In the drawings FIG. 1 is a side view of a portion of a braced space girder according to the invention, FIG. 2 is an end view of the same girder, FIG. 3 is a perspective view of the same girder on a slightly larger scale, FIG. 4 is a perspective view of a second embodiment of a braced space girder, FIG. 5 is a flat braced girder which is a preliminary stage in the production of the braced girder in FIG. 3, FIG. 6 is a flat braced girder which is a preliminary stage in the production of the girder in FIG. 4, FIG. 7 is a flat bracing also suitable for the construction of a space girder, FIG. 8 is a modification of FIG. 7.

Figure 6:
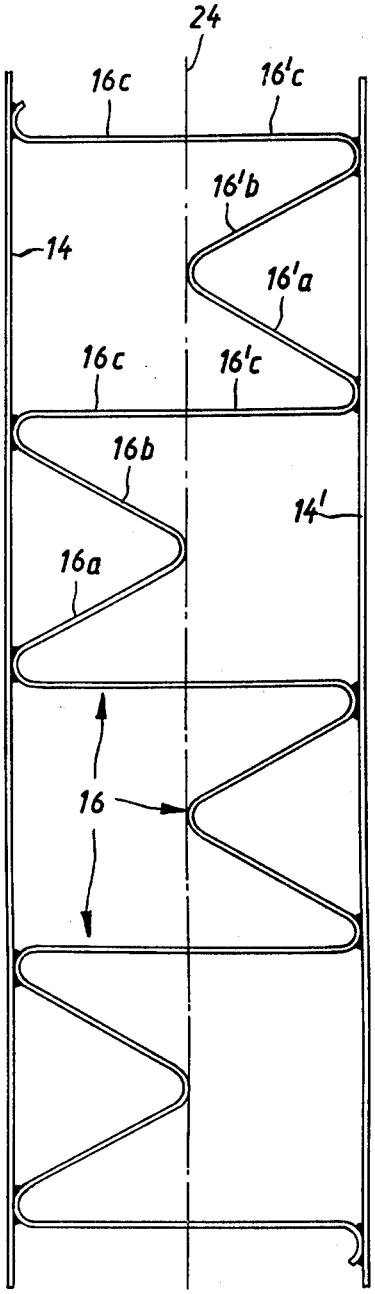
Figure 14:
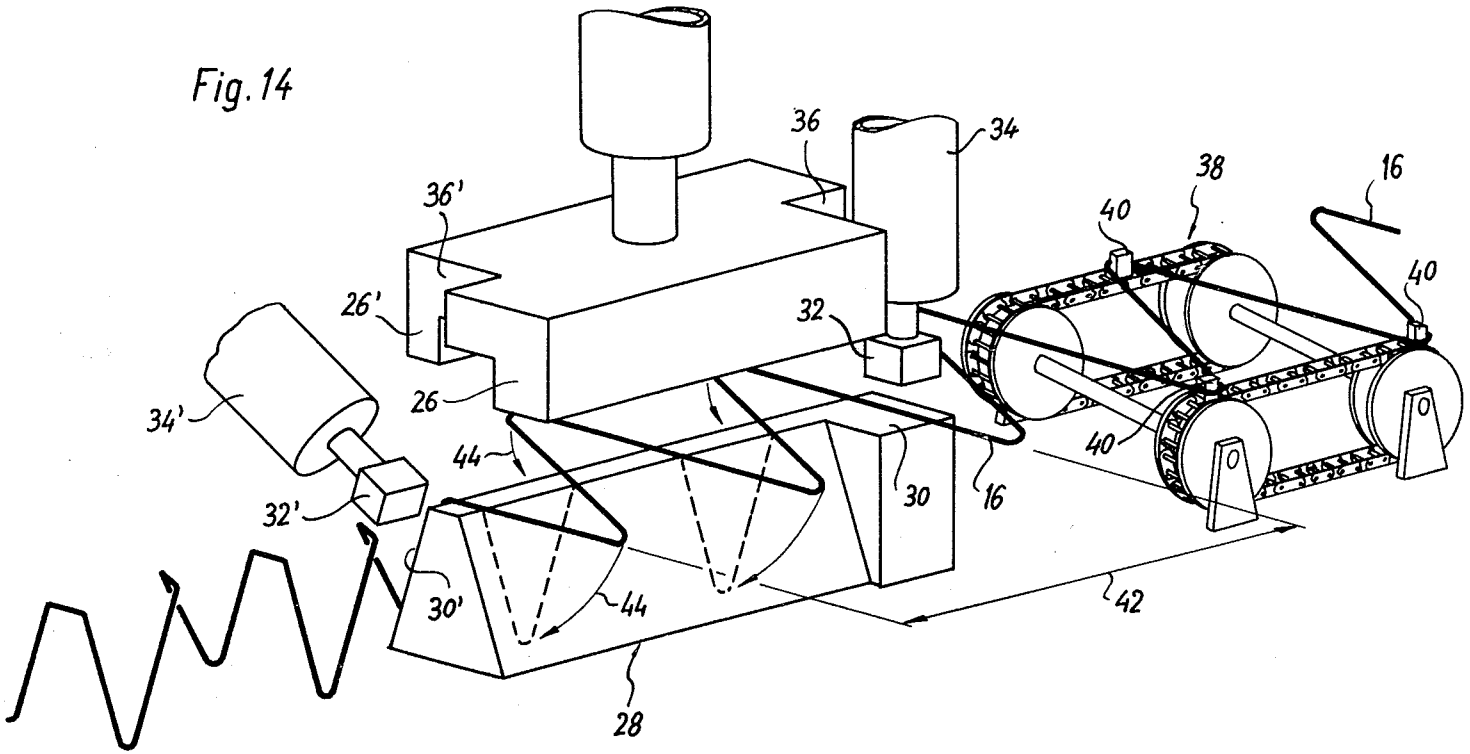

FIG. 9 is an end view of a braced space girder composed of two flat braced girders according to FIGS. 7 or 8, FIG. 10 is a modification of FIG. 9, FIGS. 11 to 13 are end views of different substantially flat braced girders producible from braced girders according to FIG. 8 or 9, and FIG. 14 is a perspective view of a machine for the production of a braced space girder according to FIG. 3 or 4 from a flat continuous lacing according to FIG. 5 or 6.

The braced girder shown in FIGS. 1 and 3 consist of a top chord 12, two bottom chords 14 and 14′ and a rod bent into a zig-zag or meandering configuration which will be hereinafter referred to as a continuous lacing 16 comprising straight portions between consecutive bends hereinafter referred to as braces. The top chord 12, the bottom chords 14 and the continuous lacing 16 in the illustrated embodiment each consist of a round section steel rod material. However, other cross sections, such as a square section, could also be used.

The braces in the open-web girder in FIG. 3 are of four kinds, namely diagonal braces 16*a*, descending from left to right from the top chord 12 to the bottom chord 14, diagonal braces 16′*b* rising from left to right from the bottom chord 14′ to the top chord 12, and braces 16*c* and 16′*c* which connect either one of the bottom chords to the top chord, and which are perpendicular to the top and bottom chords. If the continuous lacicng 16 is considered from left to right along the girder in FIG. 3 it will be seen that the sequence of braces 16*a*, 16*c*, 16′*c*, 16′*b* repeats itself. The braces define a specific pattern which is repeated a given number of times depending upon the length of the girder. Although comprising four different types of brace this pattern is highly symmetrical. If the two panel planes containing the braces are identified as 18 and 18′ according to whether they contain or are tangent to the one or the other bottom chord 14 or 14′, the disposition of the braces in the two planes 18 and 18′ is identical, provided the arrangement in plane 18 is considered from left to right and the disposition of the braces in the other plane 18′ from right to left. The bracing in FIG. 3 is symmetrical with respect to any straight line normal to the common plane of the two bottom chords 14 and 14′ and extending through one of the panel points resp. nodes 20 or 22 where the lacing 16 is welded to the top chord 12.

The lacing of the girder illustrated in FIG. 4, in addition to the braces 16*a*, 16*c*, 16′*c* and 16′*b* in FIG. 3, contains two further kinds of brace, namely braces 16′*a* which descend from left to right from the top chord 12 to the bottom chord 14′ and braces 16*b* which rise from left to right from the bottom chord 14 to the top chord 12. In the girder according to FIG. 4 there are therefore six different kinds of brace. Nevertheless this braced girder also exhibits a high degree of symmetry. The bracing is symmetrical with respect to any straight line which is normal to the common plane of the two bottom chords 14 and 14′ and contains one of the panel points 20 at the top chord at the nodes of the perpendicular braces 16*c* and 16′*c*. Moreover, the bracing in FIG. 4 is symmetrical with respect to any plane which is normal to the plane containing the two bottom chords 14 and 14′ and passes through any one of the nodes 22 of the top chord 12 with the diagonal braces 16*a*, 16*b* or 16′*a*, 16′*b*.

The braced girders in FIGS. 3 and 4 have the common feature that each two diagonal braces 16′*b*, 16*a* (FIG. 3) or 16′*b*, 16′*a* or 16*b*, 16*a* (FIG. 4) precede two perpendicular braces 16*c*, 16′*c*, which are contained in a common plane normal to the top chord 12 and to both bottom chords 14, 14′. In each individual pattern 16*a*, 16*c*, 16′*c*, 16*b* (FIG. 3) or 16*a*, 16*c*, 16′*c*, 16′*b*, 16′*a*, 16′*c*, 16*c*, 16*b* (FIG. 4), and hence in the entire girder, one half of all the braces is perpendicular to the top chord 12. Moreover, since one half of all the diagonal braces can be included in a calculation of sheat strength, three quarters of all the braces in the girders illustrated in FIGS. 3 and 4 can be considered as being effective.

The braced girders according to FIGS. 3 and 4 are easy to produce despite their seeming complexity. For example, the space girder illustrated in FIG. 3 arises by folding the flat girder in FIG. 5 about its median centre axis 24. Analogously the girder in FIG. 4 is obtained by correspondingly folding the flat girder in FIG. 6.

A space girder having the cross section shown in FIG. 9 or 10 can be assembled from two flat girders braced in the manner illustrated in FIGS. 7 respectively 8, in which the flat panel pattern formed by diagonal braces 16*a*, 16*b* and the perpendicular braces 16*c* contains pairs of consecutive directly adjacent perpendicular braces 16*c*. Whereas in FIG. 7 an ascending and descending diagonal brace 16*b* and 16*a* is followed by a pair of perpendicular braces 16*c*, the frequency of perpendicular braces in FIG. 8 is the greater, because in this latter arrangement a pair of perpendicular braces 16*c* follows each ascending or descending diagonal brace 16*b*. The ratio of perpendicular braces 16*c* to the total number of diagonal braces 16*a* and 16*b* is therefore 2 to 1.

Instead of being assembled in pairs to form a space girder the flat girders in FIGS. 7 and 8 may also be individually combined with one or two bottom chords, and for this purpose provided with the cross sectional configurations illustrated in FIGS. 11, 12 and 13. The round section steel top chord 12 may be replaced by a top chord 12''' of a different steel section, such as a U-section or a cup-shaped channel section.

The apparatus illustrated in FIG. 14 is designed to produce a continuous lacing such as that illustrated in FIGS. 3 and 4, by folding a flat continuous lacing of the kind illustratively shown in FIGS. 5 or 6. The applicability of the illustrated machine is, however, not limited to lacings containing braces extending perpendicularly to the top chord 12 and to the bottom chords 14 and 14'. Three-dimensional continuous lacings consisting entirely of diagonal braces can also be produced by folding a flat continuous lacing at its median centre line in apparatus shown in FIG. 14.

The machine illustrated in FIG. 14 contains two bending punches 26 and 26' which in combination define a U. In the illustrated embodiment both punches are integrally combined to form a single punch. The length of the punch is at least twice and preferably a multiple of the node spacings at the top chord 12. If desired the punch may be roughly as long as a finished girder. If this is the case the bottom chords 14 and 14' in FIGS. 5 and 6 can be welded to the lacing 16 before the latter is folded in the machine according to FIG. 14.

The punches 26 and 26' are replaceably attached to the ram of a commercial press, such as a brake press, and they cooperate with a forming beam 28 secured to the press underneath the punches. The cross section of the forming beam is roughly of inverted Vee-shape. The forming beam 28 in the illustrated embodiment has a flat top although this could also be rounded. In any event it is desirable that the top of the forming beam should have no sharp corners. The flat on the top of the beam 28 corresponds to the original plane of the lacing 16 which is fed to the machine from the back right to the left front in intermittent steps and folded. A clamping face 30 is provided in the feed plane at the right hand end of the forming beam 28 preceding the punch 26 in the direction of feed of the lacing 16. A downholder 32 cooperates with the clamping face 30, this downholder being attached to the vertical piston rod of a hydraulic actuator cylinder 34. The punch 26 contains a recess 36 to provide space for the downholder 32 to work. A similar downholder 32' is associated with a clamping face 30' at the left hand end of the bending beam 28 on that side which faces away from the viewer in FIG. 14. The downholder 32' is likewise attached to the piston rod of a hydraulic actuator cylinder 34'. However, this piston rod extends obliquely into the background space in a direction normal to the rear side face of the forming beam 28 facing away from the viewer.

The forming beam 28 along the top of which the lacing 16 can slide forms part of a feed path which includes an intermittently feeding drive 38. In FIG. 14 this drive is diagrammatically indicated as being a chain drive provided with driving dogs 40 for entraining the lacing 16. A similar conveyor means may also be provided on the left hand side of the forming beam 28 in FIG. 14.

The girder lacing 16 is fed in intermittent steps from right to left. Each feed step corresponds to twice the distance between consecutive nodes at one of the bottom chords 14 or 14' as indicated by the dual arrow 42. This corresponds to four times the internodal distance at the top chord 12. After each feed step the two downholders 32 and 32' are lowered and locate the length of girder lacing between the clamping faces 30 and 30' on the forming beam 28. The punches 26 and 26' are jointly lowered to fold the portions of the lacing 26 against each side of the forming beam, as indicated by the arrows 44 and their circular leading lines. The portions of the girder lacing 16 on each side of the median centre line 24 (FIGS. 5 and 6) are thus bent into the panel planes 18 and 18'. The punches 26 and 26' as well as the downholders 32 and 32' can then be lifted off the forming beam 28 to permit the girder lacing 16 to be fed another step forward and the downholders and punches to operate again.

I claim:

1. A braced girder for steel-reinforced concrete construction having a triangular cross section between a top chord and two relatively spaced bottom chords, the top chord being connected to both bottom chords by one continuous lacing forming a repeating pattern of braces which are at least roughly perpendicular to the top chord and of diagonal braces, wherein two braces in the continuous lacing which are perpendicular to the top chord follow each other consecutively.

2. A braced girder according to claim 1, wherein each brace perpendicularly connecting one bottom chord to the top chord is adjoined by another brace perpendicularly connecting the top chord to the other bottom chord, said other brace being adjoined by two consecutive diagonal braces.

3. A braced girder according to claim 1, characterised in that the braces (16*c*, 16'*c*) extending perpendicularly to the top chord (12) form directly adjacent pairs between the top chord and the same bottom chord.

4. A braced girder for steel-reinforced concrete construction, comprising a top chord (12) connected to each of two bottom chords (14, 14') by substantially straight braces forming parts of one continuous lacing contained in each of two panel planes meeting at least approximately in the axis of the top chord, said continuous lacing comprising a repeating pattern consisting of braces (16*c*, 16'*c*) which are at least approximately perpendicular to the top chord (12) and which follow each other consecutively, and of diagonal braces, and where the two panel planes (18, 18') meet, the lacing forms a radius (*r*) which is at least 0.4 times the diameter (*d*) of the top chord (12).

* * * * *